US007739954B2

(12) United States Patent
Chan et al.

(10) Patent No.: US 7,739,954 B2
(45) Date of Patent: Jun. 22, 2010

(54) CONNECTOR BLOCK WITH SHOCK TUBE RETENTION MEANS AND FLEXIBLE AND RESILIENT CLOSURE MEMBER

(75) Inventors: Sek Kwan Chan, Pierrefonds (CA); George Gary Kelly, Hawkesbury (CA); Joseph Georges Mario Lecompte, Longueuil (CA)

(73) Assignee: Orica Explosives Technology PTY, Victoria (AU)

( * ) Notice: Subject to any disclaimer, the term of this patent is extended or adjusted under 35 U.S.C. 154(b) by 1 day.

(21) Appl. No.: 11/839,866

(22) Filed: Aug. 16, 2007

(65) Prior Publication Data

US 2008/0210118 A1 Sep. 4, 2008

Related U.S. Application Data

(62) Division of application No. 10/487,946, filed as application No. PCT/AU02/01233 on Sep. 6, 2002.

(30) Foreign Application Priority Data

Sep. 7, 2001 (CA) ..... 2357267

(51) Int. Cl.
*C06C 5/04* (2006.01)

(52) U.S. Cl. ..... 102/275.7; 102/275.1; 102/275.4

(58) Field of Classification Search ..... 102/275.7, 102/275.2, 275.4
See application file for complete search history.

(56) References Cited

U.S. PATENT DOCUMENTS

| | | | | | |
|---|---|---|---|---|---|
| 4,248,152 | A | | 2/1981 | Yunan | |
| 4,424,747 | A | * | 1/1984 | Yunan | 102/275.2 |
| 4,495,867 | A | | 1/1985 | Mitchell, Jr. et al. | |
| 4,714,017 | A | * | 12/1987 | Kelly et al. | 102/275.3 |
| 4,722,279 | A | * | 2/1988 | Yunan | 102/275.4 |
| 4,815,382 | A | * | 3/1989 | Yunan | 102/275.7 |
| 5,171,935 | A | | 12/1992 | Michna et al. | |

(Continued)

FOREIGN PATENT DOCUMENTS

WO WO 01/84070 A1 11/2001

(Continued)

*Primary Examiner*—Michelle Clement
(74) *Attorney, Agent, or Firm*—Nixon & Vanderhye

(57) ABSTRACT

A connector block for retaining at least one shock tube in signal transfer relationship with a detonator. The connector block comprises a housing (2, 21) having a bore (4, 23) formed therein for receiving a detonator (6, 36) provided with a percussion-actuation end (7, 25), a shock tube retention means (8, 28) defining with the housing a slot (9, 29) for receiving therein at least one shock tube (10, 30) and holding the at least one shock tube in signal transfer relationship with the percussion-actuation end of the detonator present in the bore, the slot having an entrance (12, 32) for allowing insertion of the at least one shock tube into the slot, and a flexible and resilient closure member (11, 31) or an inflexible closure member (50) pivotable on a sprung hinge (51) extending partially or fully into the entrance. The closure member and the shock tube retention means resiliently flex to allow entry of the at least one shock tube through the entrance and into the slot, the closure member flexing through a distance at least 30% the diameter of the shock tube.

16 Claims, 5 Drawing Sheets

U.S. PATENT DOCUMENTS 5,192,828 A * 3/1993 Austin et al. ..... 102/275.12
5,204,492 A 4/1993 Jacob et al.
5,299,500 A 4/1994 Lindquist et al.
5,398,611 A 3/1995 Michna et al.
5,423,263 A 6/1995 Rontey et al.
5,463,955 A * 11/1995 Carriere ..... 102/275.2
5,499,581 A 3/1996 Sutula, Jr.
5,524,547 A 6/1996 Kelly et al.
5,659,149 A 8/1997 Sutula, Jr.
5,703,319 A 12/1997 Fritz et al.
5,792,975 A 8/1998 Tseka et al.
6,006,671 A * 12/1999 Yunan ..... 102/275.11
6,123,025 A 9/2000 Jacob et al.
D443,331 S 6/2001 Lidmar
6,305,287 B1 * 10/2001 Capers et al. ..... 102/275.7
6,349,648 B1 * 2/2002 Capers et al. ..... 102/275.4
6,513,437 B2 2/2003 Chan et al.
6,681,701 B2 1/2004 Perry
6,694,886 B1 * 2/2004 Woodall et al. ..... 102/275.1
2002/0162473 A1 11/2002 Chan et al.
2003/0084812 A1 5/2003 Perry
2004/0055494 A1 3/2004 O'Brien

FOREIGN PATENT DOCUMENTS

WO WO 03/023316 A1 3/2003

* cited by examiner

CONNECTOR BLOCK WITH SHOCK TUBE RETENTION MEANS AND FLEXIBLE AND RESILIENT CLOSURE MEMBER

CROSS REFERENCE TO RELATED APPLICATIONS

This application is a divisional of co-pending U.S. patent application Ser. No. 10/487,946 filed Oct. 1, 2004, which is a national phase application based on International Application Serial No. PCT/AU2002/01233 filed Sep. 6, 2002.

FIELD OF THE INVENTION

The present invention relates to connector blocks for positioning shock tubes in signal transmission relationship with the percussion-actuation end of a detonator. In particular, the present invention relates to connector block designs with improved means for securing the shock tubes therein.

BACKGROUND TO THE INVENTION

Blasting operations frequently trigger a series of explosions in an exact order, with precise timing. For this purpose, blasting systems have been developed that employ shock tubes (also known as signal transmission lines) that transfer a blast initiation signal to an explosive charge. A signal from a single shock tube can be transferred to multiple shock tubes in a blasting system via the use of connector block/detonator assemblies, thereby permitting the initiation of multiple explosive charges in a controlled manner.

Safety and reliability are paramount for any blasting system, and efficient shock tube initiation is an important factor in this regard. Shock tubes that fail to initiate result in unexploded charges at the blast site, with inevitable safety concerns. Moreover, the reliable initiation of shock tubes is imperative to ensure that the required blasting pattern is effected.

The efficiency of shock tube initiation is dependent primarily upon connector block design. Reliable initiation of shock tubes requires the transfer of sufficient energy from the base charge of the detonator to the shock tubes, thereby compressing the shock tubes rapidly with sufficient energy and speed to initiate them.

The shock tube retention means of a connector block holds one or more shock tubes in contact with, or close proximity to, the percussion-actuation end of the detonator retained within the block. Importantly, the shock tube retention means ensures that the shock tubes are retained in signal transmission relationship with the detonator. Several examples of connector block designs are known in the art, which comprise a shock tube retention means for holding at least one shock tube adjacent to the percussion-actuation end of the detonator. These examples generally encompass the use of a flexible clip-like member, integral to the connector block, for retaining the shock tubes within a slot formed between the clip-like member and the percussion-actuation end of the detonator. In this way, the shock tubes are retained in signal transmission relationship with the end of the detonator.

In one example, U.S. Pat. No. 5,204,492, issued to ICI Explosives USA Inc. on Apr. 20, 1993, discloses a detonator assembly for initiating up to eight transmission lines. The assembly comprises a connector block that houses a low strength detonator by means of a confining wall surrounding the closed end of the low strength detonator. One or more signal transmission lines can be inserted through a gap in the confining wall and operatively confined adjacent to the closed end of the low strength detonator.

U.S. Pat. Nos. 5,171,935 and 5,398,611, issued to the Ensign Bickford Company on Dec. 15, 1992 and Mar. 21, 1995 respectively, disclose a connector block having a housing with a channel formed therein for receiving a low energy detonator. The connector block further comprises a shock tube engaging member for holding shock tubes (referred to as transmission tubes) adjacent an end of the channel, wherein the tube engaging member is attached to the connector block via a resiliently deformable segment. Shock tubes may be inserted into a slot formed between the housing and the tube engaging member.

U.S. Pat. No. 5,499,581 issued to the Ensign-Bickford Company on Mar. 19, 1996, discloses a connector block design for connecting signal transmission lines in a blasting system. The patent discloses improved means for securing a detonator within the connector block via a displaceable locking member. The connector block may further comprise a flexible, cantilevered line retaining means to receive one or a plurality of outgoing signal transmission lines.

In another example, U.S. Pat. No. 5,703,319, issued to the Ensign Bickford Company on Dec. 30, 1997, discloses a connector block comprising a clip member. The clip member cooperates with the signal transmission end of a body member to define a slot for receiving one or more signal transmission lines in communication with the output end of a detonator. The clip member is characterised in that it comprises a section of continuously reducing thickness to facilitate lateral insertion of signal transmission lines into the slot by deformation of the clip member.

In another example, U.S. Pat. No. 5,659,149 issued to the Ensign Bickford Company on Aug. 19, 1997 discloses connector blocks comprising a slot for retaining a single acceptor line in an undulate configuration therein (i.e. the single acceptor line is contorted to have multiple bends or kinks). In a preferred embodiment, the connector blocks may further include a moveable retainer member located on a side of the slot opposite the detonator end. The moveable retainer member is generally integral with the shock tube retention means, and includes a barb for retaining the single acceptor line in position adjacent the end of a detonator.

In a final example, the so called Handidet™ X405 provides for a connector block for retaining shock tubes in signal transmission relationship with the percussion-actuation end of a detonator. The shock tubes are retained in a slot defined between a flexible shock tube retention means and the adjacent housing of the connector block. The entrance to the slot is formed between a semi-rigid member integral with the housing, and a flexible tip integral with the flexible shock tube retention means. Shock tubes may be inserted through the entrance of the slot by deformation of the flexible shock tube retention means (and, in particular, the flexible tip), and the semi-rigid member integral with the housing. Importantly, the access to the slot depends primarily upon the flexibility of the shock tube retention means and the flexible tip. Although the semi-rigid member exhibits a limited degree of flexibility, the principle function of this member is to retain the shock tubes within the connector block once inserted into the slot.

The connector blocks disclosed in the prior art generally comprise shock tube retention means comprising a material with a significant degree of resilient flexibility. The flexibility of the shock tube retention means permits facile insertion of the shock tubes between the shock tube retention means and the percussion-actuation end of a detonator housed within the block. For this purpose, the shock tube retention means comprises a member that can be temporarily deformed by application of force by the user, thereby allowing access to a slot (or equivalent thereof) for insertion of the shock tubes therein. Release of the force permits the shock tube retention means to assume its original configuration, and retain the shock tubes in the slot.

A variation on this theme is provided by U.S. Pat. No. 5,659,149 (as previously described), in which a single acceptor line is retained by a resilient barbed member generally integral with the shock tube retention means. Nonetheless, the configuration of the disclosed connector blocks is such that only a single line may be retained, and the shock tube retention means comprises complex components that reduce the integrity of the connector block upon detonator initiation, thereby increasing the quantity of shrapnel.

SUMMARY OF THE INVENTION

The inventors of the present application have encountered significant problems with the connector blocks of the prior art that include flexible or insubstantial shock tube retention means. Firstly, shock tube retention means that are at least partly flexible exhibit a measurable degree of residual plastic deformation. Consequently, such shock tube retention means sometimes fail to retain shock tubes with sufficient precision of placement adjacent the percussion actuation end of a detonator. Secondly, the shock tubes may be retained with insufficient friction, thereby resulting in the connector block sliding along the length of the shock tubes retained therein. Thirdly, connector blocks comprising at least partially flexible shock tube retention means can exhibit reduced integrity upon detonator actuation causing increased shrapnel.

The present invention, at least in preferred forms, aims to provide a connector block for accurate positioning of shock tubes in signal transmission relationship with the percussion-actuation end of a detonator, wherein the connector block prevents inadvertent removal of the shock tubes.

A further object of the present invention, at least in preferred forms, is to provide a connector block that does not normally fragment upon actuation of a detonator housed therein. In this way, the quantity of shrapnel is reduced.

A further object of the present invention, at least in preferred forms, is to provide a connector block wherein the force required to insert a shock tube into the connector block is suitable for facile manual operation, yet once inserted the shock tube is securely retained.

A further object of the present invention, at least in preferred forms, is to provide a connector block for retaining shock tubes in accurate energy communicating relationship with the percussion-actuation end of a detonator.

A connector block for retaining at least one shock tube in signal transfer relationship with a detonator, the connector block comprising:

a housing having a bore formed therein for receiving a detonator provided with a percussion-actuation end and a base charge disposed within the percussion-actuation end, the bore having an insertion end for receiving the detonator and a signal transmission end for positioning the percussion-actuation end of the detonator in signal transfer relationship with said at least one shock tube;

a shock tube retention means integral with the housing and extending to project over the signal transmission end of said bore, to define with the housing a slot for receiving therein at least one shock tube, and to hold said at least one shock tube in signal transfer relationship with said percussion-actuation end of said detonator present in said bore, said slot having an entrance for allowing insertion of each shock tube into said slot; and a flexible and resilient closure member integral with the housing and extending partially or fully into said entrance;

wherein said shock tube retention means has limited flexibility, and said closure member resiliently flexes away from said entrance to allow entry of each shock tube through said entrance and into said slot, said closure member flexing through a distance at least 60%, preferably at least 90%, of the diameter of the shock tube(s).

Most preferably, the shock tube retention means is so rigid that it undergoes little or no flexing when a shock tube is inserted into the slot. Ideally, the shock tube retention means is so rigid and so firmly attached to the housing that it remains in place following actuation of the detonator.

Preferably, the connector block comprises a substantially uniform material throughout, and differences in the relative thickness of the material comprising the shock tube retention means and the flexible and resilient closure member cause the relative flexibility of the closure member and the relatively inflexibility of the shock tube retention means necessary for the difference in flexibility mentioned above. Preferably, a shock tube may be inserted into the slot with a force of about 45 Newtons (about 10 pounds force) or less.

In an alternative aspect of the present invention, there is provided a connector block for retaining at least one shock tube in signal transfer relationship with a detonator, wherein the connector block comprises;

a housing having a bore formed therein for receiving a detonator provided with a percussion-actuation end and a base charge disposed within the percussion-actuation end, the bore having an insertion end for receiving the detonator and a signal transmission end for positioning the percussion-actuation end of the detonator in signal transfer relationship with said at least one shock tube;

a substantially rigid shock tube retention means integral with the housing and extending to project over the signal transmission end of said bore, to define with said housing a slot for receiving therein at least one shock tube and holding said at least one shock tube in signal transfer relationship with said percussion-actuation end of said detonator present in said bore, said slot having an entrance for allowing insertion of said at least one shock tube into said slot; and a closure member extending partially or fully into said entrance and attached to said housing via a sprung hinge, said closure member being arranged relative to said entrance to allow entry of said at least one shock tube into said slot by movement of said closure member about said sprung hinge against a bias.

In accordance with the present invention, at least in a preferred form, the combined use of a shock tube retention means of limited flexibility, together with a flexible and resilient closure member permits significantly easier shock tube insertion, accurate shock tube positioning, and secure shock tube retention. Moreover, the limited flexibility of the shock tube retention means is expected to improve the resilience of the connector block to fragmentation upon detonator actuation, thereby reducing the amount of shrapnel generated.

Preferably, the closure member extends partially or fully into the entrance of the slot at an angle of from about 45° to about 135° relative to the longitudinal axis of the bore. More preferably, the closure member extends partially or fully into the entrance of the slot at an angle of from about 45° to about 90° relative to the longitudinal axis of the bore. In this way, the closure member is configured to avoid interference with the housing upon flexing of the closure member away from the entrance to the slot.

The connector blocks of the present invention may further comprise a shock tube insertion guide integral with the shock tube retention means, the shock tube insertion guide defining with the closure member a receiving space for guiding shock tubes to the entrance of the slot. Preferably, the receiving space narrows at an end adjacent the opening of said slot, thereby facilitating insertion of the shock tubes into the slot.

DETAILED DESCRIPTION OF THE DRAWINGS

FIG. 1*a* is a cross sectional view of the Handidet™ X405 connector block (prior art).

FIG. 1*b* is a cross sectional view of the Handidet™ X405 connector block illustrating deformation of the shock tube retention means to permit slot access for shock tube insertion (prior art).

DEFINITIONS

Figure 1A:
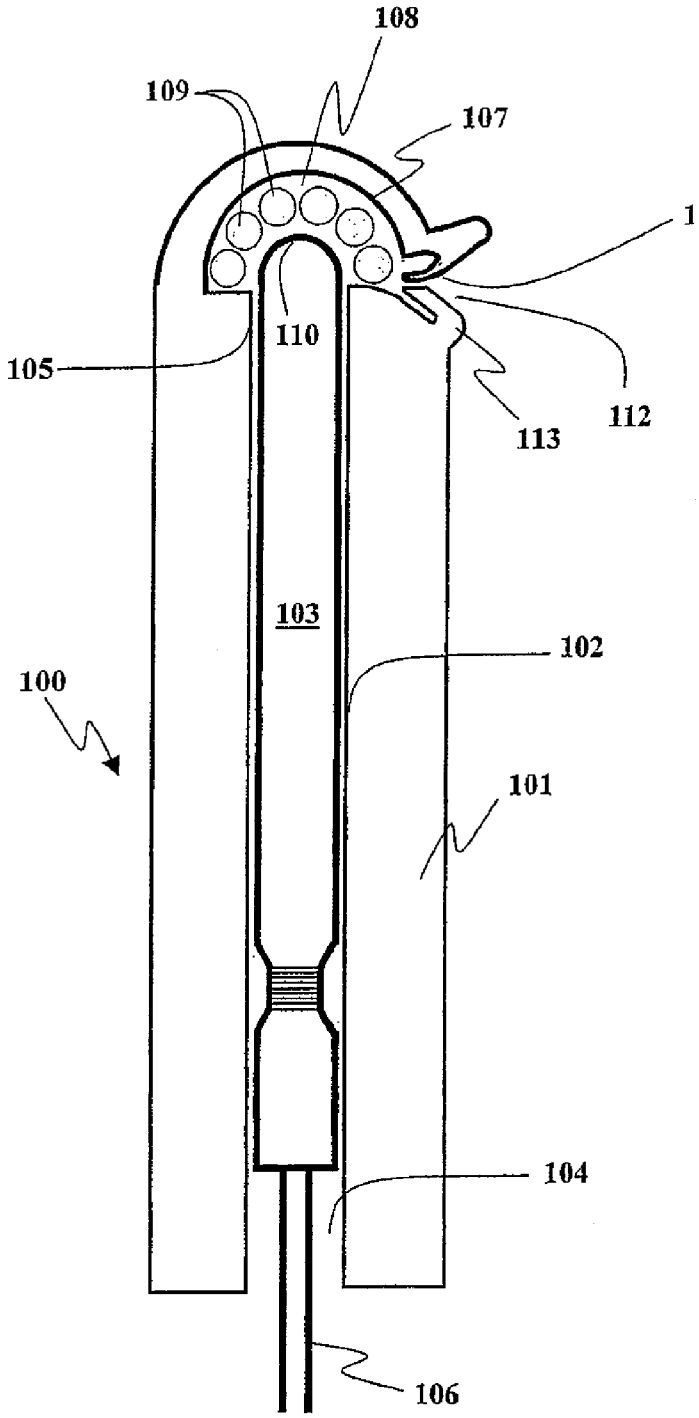
Figure 1a (Prior Art)

"Limited flexibility"—cannot be substantially flexed or distorted by hand.

"Shock tube retention means with limited flexibility"—a member integral to a connector block for retaining at least one shock tube in signal communicating relationship with the percussion-actuation end of a detonator, the member defining a slot for retaining shock tubes therein, wherein the member may not be substantially flexed by hand, in accordance with the definition of the term 'limited flexibility'. In this way, the slot has a generally predetermined thickness that may not be readily changed by hand manipulation of the shock tube retention means.

"Bore"—either a substantially cylindrical hole running though the housing of the connector block of the present invention, or an open-sided channel or groove formed in a side of the housing of the connector block, configured to house a detonator.

"0° relative to the longitudinal axis of the bore"—an orientation for a member extending in a direction parallel with the longitudinal axis of the bore, from the insertion end to the signal transmission end of the bore (of the connector blocks of the present invention).

"180° relative to the longitudinal axis of the bore"—an orientation for a member extending in a direction parallel with the longitudinal axis of the bore, from the signal transmission end to the insertion end of the bore (of the connector blocks of the present invention).

DETAILED DESCRIPTION OF THE PREFERRED EMBODIMENTS

For efficient shock tube initiation, the shock tubes should be positioned carefully within a connector block to receive optimal energy transfer from the detonator. In this way, the shock tubes are compressed extremely rapidly and evenly by the force of detonator actuation, and are thereby initiated. The inventors of the present application have determined that for optimal energy transfer, the shock tubes should preferably be in direct contact with the surface of the percussion-actuation end of the detonator (or the surface of a positioning element, which is itself in contact with the detonator).

Therefore, the present application provides an improved connector block design, wherein the shock tubes can be retained in efficient signal transmission relationship with the detonator, preferably without the presence of an air gap between the shock tubes and the surface of the percussion-actuation end of the detonator. In particular, the configuration and properties of the components of the connector blocks of the present invention, permit shock tubes to be easily inserted and retained without the need for excessive insertion forces.

Specifically, the inventors of the present invention have ascertained that shock tube retention means that deliberately exhibit an inherent degree of flexibility (for facile shock tube insertion), are not conducive to optimal shock tube positioning. Firstly, the material of the retention means may not properly reassume its original shape after distortion to allow shock tube entry, thereby affecting the width of the shock tube retention slot. Secondly, the presence of one or more shock tubes within the slot can alter the configuration of the flexible retention means, thereby affecting slot width for subsequent shock tube insertion. Moreover, when the shock tubes are forced into position, the flexibility of the retention means increases the risk of shock tube cross-over within the slot, which can result in poor shock tube compression, and initiation failure.

Figure 1B:
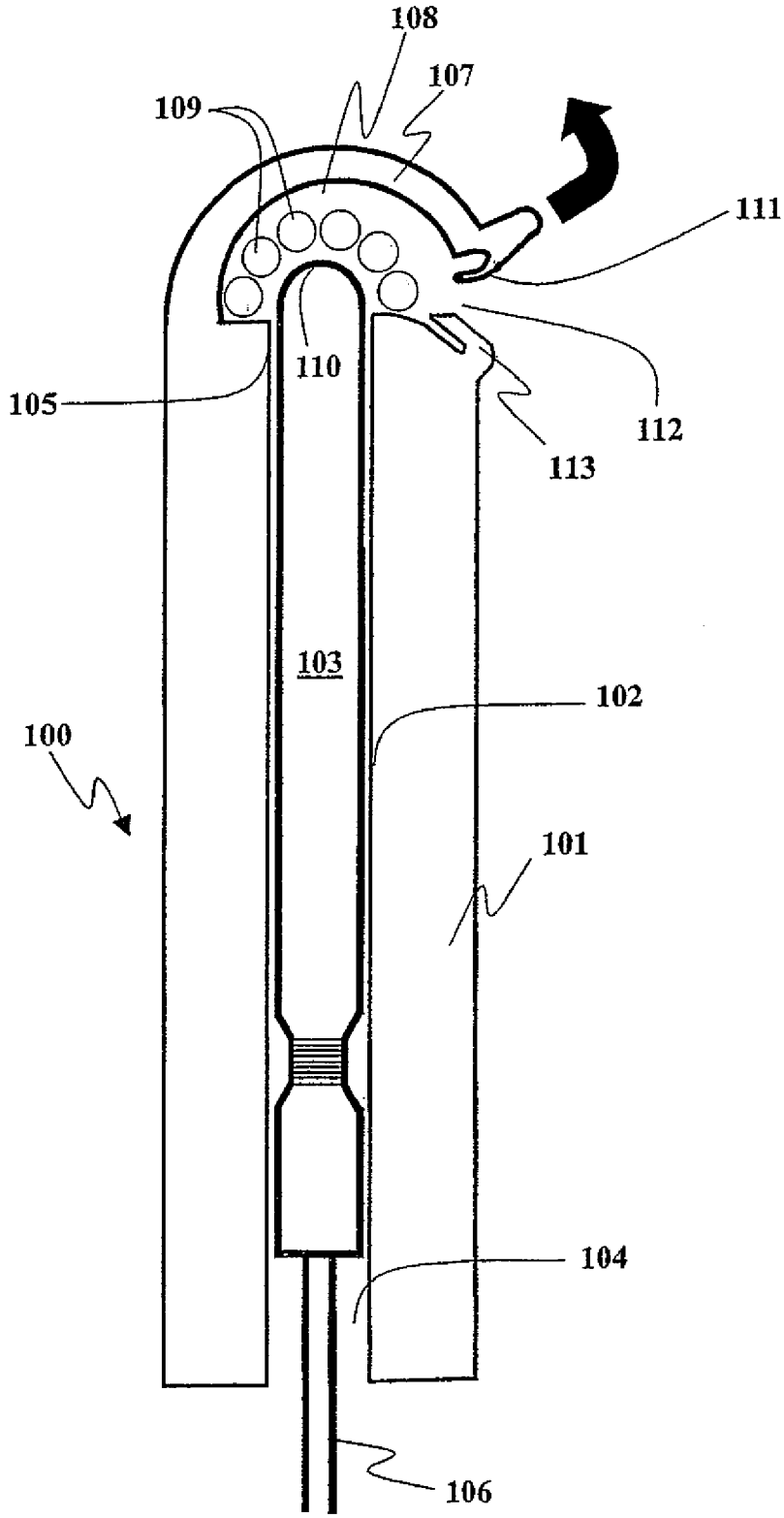
Figure 1b (Prior Art)

The problems encountered with the connector blocks of the prior art are illustrated with reference to FIGS. 1*a* and 1*b*. As an example, FIGS. 1*a* and 1*b* illustrate the Handidet™ connector block. The connector blocks of the present invention provide significant improvements over the Handidet™ shown in FIGS. 1*a* and 1*b*, and other similar connector block designs of the prior art. Although the connector blocks of the present invention have a configuration similar to that of the Handidet™ connector block, the relative flexibility of the various components is different. In this way, the connector blocks of the present invention provided significant and unexpected improvements over those of the prior art by permitting easier shock tube insertion, more secure shock tube retention, and less shock tube damage upon insertion.

With reference to FIG. 1*a*, the Handidet™ connector block 100 comprises a housing 101 with a longitudinal bore 102 formed therein, configured from receiving a detonator 103. The bore comprises an open end 104 into which the detonator is inserted, and a signal transmission end 105. The detonator input shock tube 106 enters the bore via open end 104. The percussion-actuation end 110 of the detonator 103 is positioned adjacent to the signal transmission end of the bore 105. The Handidet™ connector block also comprises a flexible shock tube retention means 107 that is integral with the housing 101 at the signal transmission end of the bore. The flexible shock tube retention means and the housing define a slot 108 there between, configured for the retention of shock tubes 109 adjacent to the percussion-actuation end 110 of the detonator 103.

Importantly, the flexible shock tube retention means 107 has to be deformed and flexed away from the housing 101 (as illustrated in FIG. 1*b*) to permit access to the slot 108, for insertion of shock tubes 109 therein. The shock tube retention means 107 may further comprise a flexible lip 111 integral to the shock tube retention means adjacent to the entrance 112 of the slot. The flexible lip 111 further improves the overall flexibility of the shock tube retention means, and the ease of lateral insertion of shock tubes through the entrance 112, and into the slot 108.

The Handidet™ further comprises a semi-rigid member 113 integral to the housing at the signal transmission end, and extending into the entrance of the slot. Importantly, the semi-rigid member exhibits limited flexibility, intended primarily to assist in retaining shock tube(s) within the slot, and prevent their accidental removal from the slot. Preferably, the connector block is configured such that the entrance to the slot is narrower than the diameter of a shock tube to be inserted therein. In this way, insertion of a shock tube through the entrance and into the slot requires application of an insertion force upon both the flexible shock tube retention means, and the semi-rigid member. The shock tube can be pushed through the entrance by flexing the flexible shock tube retention means (and the flexible tip) away from a resting position, as illustrated in FIG. 1*b*. Although the semi-rigid member exhibits limited flexibility, the member can also be expected to move slightly from a resting position as the shock tube is pushed through the entrance of the slot.

The present invention differs from the Handidet™ (and other connector block designs) in two principle respects. Firstly, the connector blocks of the present invention do not comprise a deliberately flexible shock tube retention means, but instead comprise a shock tube retention means that has limited flexibility. In addition, the connector blocks do not comprise a semi-rigid member, but instead comprise a flexible and resilient closure member.

Through careful experimentation, the inventors of the present application have determined that significant and unexpected improvements in operation and safety can be conferred to a connector block by the combined use of a shock tube retention means of limited flexibility, together with a flexible and resilient closure member. The connector blocks of the present invention have a similar configuration to the existing Handidet™ series of connector block, but importantly the flexible properties of the shock tube retention means and the closure member are essentially reversed. In this way, the force required for shock tube insertion can be reduced by more than 50% (see Example 1). It follows that ease of handling in the field is markedly improved, and the shock tubes are much less likely to become damaged by excessive insertion forces. In turn, this can improve the reliability of shock tube initiation, improving the safety and performance of the blasting system.

Ease of handling at the blast site is an essential consideration for connector block design. For this reason, substantially inflexible shock tube retention means have not been previously extensively employed in the connector blocks of the prior art. For proper retention of shock tubes within the slot, the width of the slot is preferably slightly narrower than the cross sectional diameter of the shock tubes. In this way, the shock tubes are slightly squeezed without inducing any substantially change in the diameter of the tubes. It follows that, very high insertion forces are generally required to force shock tubes into a slot defined by a substantially inflexible shock tube retention means, thereby increasing the risk of shock tube damage upon insertion, and subsequent loss of initiation capacity.

The connector blocks of the present invention have been developed to improve both the reliability and safety of blasting systems. Specifically, the connector blocks of the present invention provide significant improvements in detonator to shock tube energy transmission. The connector blocks of the present invention comprise shock tube retention means with limited flexibility, to define a shock tube retention slot of a generally fixed width. In this way, the shock tubes are retained in an optimal position to receive energy from detonator actuation, preferably in intimate contact with the surface of the detonator. Moreover, the problems relating to high shock tube insertion forces encountered with the connector blocks of the prior art are substantially overcome by the provision of a flexible and resilient closure member.

The inventors of the present application have determined that this feature, in combination with a shock tube retention means of limited flexibility, provides a significantly improved connector block that is easy to handle, permits facile shock tube insertion for reliable initiation, and generates less shrapnel upon detonator actuation. Unexpectedly, the inventors have discovered that the insertion force needed to insert a shock tube into the slot can be significantly reduced by providing a connector block configuration in accordance with the present invention. The ease of handling is thus improved, and there is a significantly reduced risk of damaging the shock tubes by excessive insertion forces. Since the connector blocks of the present invention comprise a shock tube retention means of limited flexibility, several additional advantages are conferred. In this regard, the relative inflexibility of the shock tube retention means renders the means less susceptible to deformation or fragmentation upon detonator actuation. Therefore, more actuation energy is directed to compressing the shock tubes and less energy is wasted. It follows that the connector blocks of the present application may permit the use of lower energy detonators, thereby reducing the quantity of shrapnel generated, and the safety and reliability of the blasting system.

Preferably, the flexible and resilient properties of the closure member provide confirmation of shock tube insertion into the slot, by inducing an audible 'click'. The closure member substantially reduces the risk of accidental shock tube removal. Preferably, the closure member is dimensioned and configured to assist in the retention of the shock tube inserted into the slot and located adjacent to the entrance of the slot.

In accordance with the present invention, the closure member may encompass any means of partially or completely covering the entrance to the slot. Moreover, in one embodiment, the closure member may comprise any material that exhibits the properties of flexibility and resilience. Preferred materials include plastics, which may be integral with the material of the housing as appropriate. In this regard, the relative thickness of the plastic may dictate the relative flexibility or rigidity of the connector block component. For example, the shock tube retention means may comprise a relatively thick portion of plastic compared with the closure member, thereby limiting the flexibility of the component. In one embodiment, the flexible and resilient closure member may comprise the same plastic material as the shock tube retention means. However, in contrast to the shock tube retention means the closure member may exhibit increased resilient flexibility resulting from the reduced thickness of the integral plastic component.

In an alternative embodiment, the closure member may comprise a relatively flexible plastic, whereas the rigid shock tube retention means may comprise an alternative, more rigid plastic material. In this way, differences in the plastic material of the connector block components may confer the desired properties of flexibility to each of the shock tube retention means and the closure member.

In a further alternative embodiment, the flexible and resilient closure member may comprise a metal. In this regard, the closure member may consist essentially of the metal, or the closure member may comprise a metal insert surrounded by a plastic material preferably integral with the housing.

The present invention also encompasses a connector block comprising a closure member affixed to the housing of the connector block via a hinge, wherein the hinge is sprung to bias the closure member to partially or completely cover the entrance to the slot. When a shock tube is inserted laterally into the connector block, the closure member is forced to move about the hinge against the bias of the spring, thereby uncovering the entrance to the slot and permitting access of the shock tube.

Preferred embodiments of the present invention are described with reference to the FIGS. 2 to 4.

Figure 2:
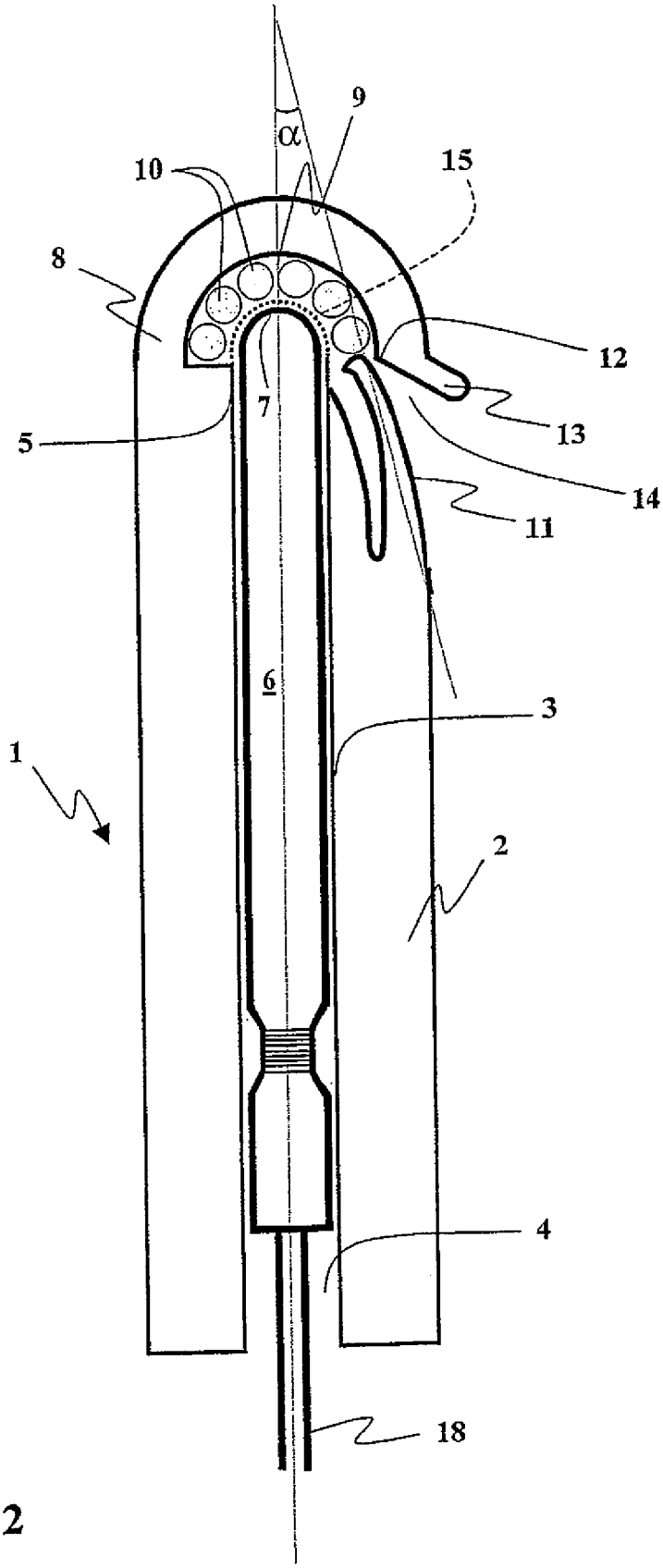
FIG. 2 is a cross-sectional view of an embodiment of the present invention, wherein the closure member extends inwardly towards the opening of the slot at an angle of less than 45° incident to the longitudinal axis of the bore.

FIG. 2 illustrates an embodiment of the present invention wherein the flexible and resilient closure member extends towards the longitudinal axis of the bore at a low angle (i.e. an angle of less than 45°). The embodiment encompasses a connector block 1 comprising a housing 2 with a bore 3 running through the housing, the bore having an insertion end 4 and a signal transmission end 5. The bore is configured for receiving a detonator 6, wherein the detonator is inserted into the insertion end of the bore, and positioned with the percussion-actuation end 7 of the detonator at the signal transmission end of the bore. An input shock tube 18 may extend from the end of the detonator opposite the percussion actuation end, and through the insertion end of the bore. A positioning membrane 15 (e.g. a thin layer of plastic material forming a dome extending across the end of the bore) may be present within the bore at the signal transmission end, for locating the surface of the percussion-actuation end of the detonator in signal transmission relationship with shock tubes.

The connector block further comprises a shock tube retention means of limited flexibility 8 that is integral with the housing 2 adjacent the signal transmission end of the bore. The shock tube retention means forms a slot 9 for the retention of shock tubes, wherein the slot is defined by the inner surface of the shock tube retention means, the housing, and the surface of the percussion actuation end of the detonator (or the positioning surface, if present). In the embodiment shown in FIG. 2, the slot is dimensioned of uniform width, sufficient for the retention of shock tubes without unduly squeezing the shock tubes. Moreover, the limited flexibility of the shock tube retention means prevents substantial changes in the width of the slot both during and following shock tube insertion. The shock tubes 10 may be inserted laterally into the slot via an entrance 12. The surface of the percussion-actuation end 7 of the detonator is hemispherical in shape, and the shock tubes may be arranged around the percussion-actuation end of the detonator approximately equidistant from the base charge within the percussion-actuation end of the detonator. In alternative embodiments, the connector block may be adapted to receive a detonator with alternative percussion-actuation end configurations that are not hemispherical. However, the connector block is most preferably configured to receive a detonator with a hemispherical end, in accordance with the teachings of U.S. patent application Ser. No. 09/559,662 and the equivalent International patent application WO 01/84070.

The connector block further comprises a flexible and resilient closure member 11, extending partially or fully into the entrance of the slot. The application of an external force to the closure member moves the closure member from its resting state against a bias, thereby uncovering the entrance sufficient to permit the lateral insertion of a shock tube. The insertion of a shock tube through the entrance flexes the closure member 11 away from its resting position. Some flexing may also occur in the shock tube retention means. However, given the limited flexibility of the shock tube retention means, the flexing of this component is minimal. In this regard, the closure member flexes through a distance at least 2 times greater than the shock tube retention means. In preferred embodiments, the degree of flexing of the closure member is even greater relative to the flexing of the shock tube retention means. In a most preferred embodiment, the shock tube retention means is so rigid that it undergoes little or no flexing upon shock tube insertion. However, since the connector blocks of the present invention are preferably comprised of a plastic material, the shock tube retention means may exhibit some unavoidable resilient flexibility.

Once the shock tube has been inserted, the closure member reassumes a resting state in a position to partially or completely cover the opening of the slot. Preferably, the release of the closure member back to its resting position generates an audible 'click'-like sound, that provides positive verification that the shock tube has been fully inserted into the slot. In an alternative embodiment of the present invention, the closure member may contact a shock tube located in the slot adjacent the entrance of the slot, to assist in the retention of the shock tube.

A preferred feature of the connector block designs of the present invention relates to a shock tube insertion guide 13. The shock tube insertion guide is integral with the rigid shock tube retention means, and extends away from the entrance of the slot. The shock tube insertion guide defines a receiving space 14 between the shock tube insertion guide and the closure member. In this way, the receiving space facilitates the lateral insertion of shock tubes into the connector block. This improves ease of operation and handling at the blast site. The shock tubes may be positioned in the receiving space and located adjacent to the entrance of the slot, in juxtaposition with the closure member. Upon application of light pressure to the shock tube, the shock tube may be pushed past the closure member and into the slot principally by deflection of the closure member away from its resting position. Preferably, the shock tube insertion guide is configured to provide a receiving space that is narrower at an end adjacent the entrance of the slot. In this way, the end of the receiving space opposite the entrance of the slot is wider, thereby permitting facile insertion of a shock tube therein.

With reference to the embodiment shown in FIG. 2, at a resting state the closure member extends inwardly towards the opening of the slot at a low angle (i.e. an angle of less than 45°) relative to the longitudinal axis of the bore. This angle is illustrated in the embodiment shown in FIG. 2 as '$\alpha$'. The present invention encompasses embodiments wherein the angle $\alpha$ may be from 0° to 180° relative to the longitudinal axis of the bore.

Although the closure member of the present invention is considered operable at a wide range of $\alpha$, in accordance with a preferred embodiment of the present invention, $\alpha$ is preferably from 45° to 135°. In this way, the closure member is configured to extend inwardly from an outer surface of the housing towards the opening of the slot, at a high angle (i.e. closer to the perpendicular) relative to the longitudinal axis of the bore. This embodiment of the present invention is described with reference FIG. 3.

Figure 3:
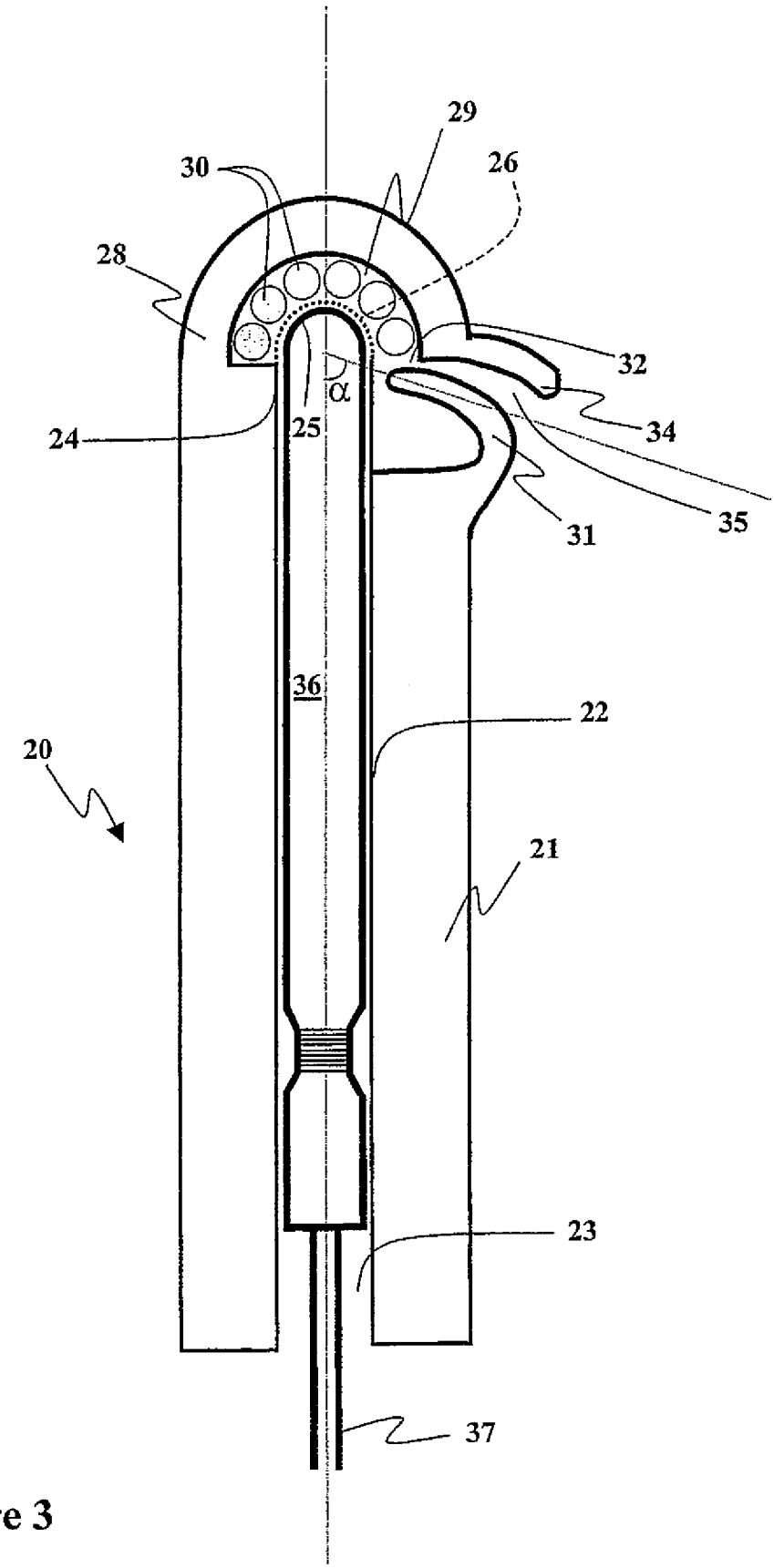
FIG. 3 is a cross-sectional view of a preferred embodiment of the present invention, wherein the closure member extends inwardly towards the opening of the slot at an angle of between 45° and 135° incident to the longitudinal axis of the bore.

FIG. 3 illustrates a preferred connector block of the present invention, for the positioning of shock tubes in signal transmission relationship with the percussion-actuation end of a detonator. The embodiment of the invention shown in FIG. 3 is substantially similar to that shown in FIG. 2, with the exception of the configuration of the closure member. In accordance with the embodiment shown in FIG. 3, the connector block 20 comprises a housing 21 and a bore 22 running longitudinally through the housing, the bore comprising an insertion end 23 and a signal transmission end 24. The bore is configured to receive a detonator 36, wherein the percussion-actuation end 25 of the detonator is located adjacent the signal transmission end of the bore. In one embodiment, a positioning surface 26 is present within the bore at the signal transmission end, and located with the surface of the percussion-actuation end of the detonator in signal communicating relationship with shock tubes to be subsequently located in the connector block.

In accordance with the present invention, the connector block shown in FIG. 2 comprises a shock tube retention means of limited flexibility 28 that is integral with the housing 21 adjacent the signal transmission end of the bore. The shock tube retention means forms a slot 29 for the retention of shock tubes, the slot defined by the inner surface of the shock tube retention means and the surface of the percussion actuation end of the detonator (or the positioning surface, if present). Preferably, the slot has uniform width, sufficient for the retention of shock tubes therein without unduly squeezing the shock tubes. Moreover, the limited flexibility of the shock tube retention means prevents substantial changes in the width of the slot both during and following shock tube insertion. The shock tubes 30 may be inserted laterally into the slot via an entrance 32. In the embodiment illustrated in FIG. 2, the surface of the percussion-actuation end of the detonator is hemispherical in shape, and the shock tubes may be arranged around the percussion-actuation end of the detonator approximately equidistant from the base charge within the percussion-actuation end. In alternative embodiments of the present invention, the connector block may be configured to house a detonator comprising a percussion-actuation end that is not hemispherical.

The connector block further comprises a flexible and resilient closure member 31, extending partially or fully into the entrance of the slot. The application of an external force to the closure member moves the closure member from its resting state against a bias, thereby uncovering the entrance sufficient to permit the lateral insertion of a shock tube. The insertion of a shock tube through the entrance flexes the closure member 31 away from its resting position. Some flexing may also occur in the shock tube retention means. However, given the limited flexibility of the shock tube retention means, the flexing of this component is minimal. In this regard, the closure member flexes through a distance at least 2 times greater than the shock tube retention means. In preferred embodiments, the degree of flexing of the closure member is even greater relative to the flexing of the shock tube retention means. In a most preferred embodiment the shock tube retention means is so rigid that it undergoes little or no flexing upon shock tube insertion. However, since the connector blocks of the present invention are preferably comprised of a plastic material, the shock tube retention means may exhibit some unavoidable resilient flexibility.

In an alternative embodiment of the present invention, the closure member contacts a shock tube located in the slot adjacent the entrance of the slot, to assist in the retention of the shock tube. FIG. 3 illustrates a preferred embodiment of the invention having regard to the closure member. In accordance with the connector block shown in FIG. 3, the closure member is preferably configured to extend into the entrance of the slot at an angle $\alpha$ of from 45° to 135°, (more preferably 45° to 90° as shown in FIG. 2), relative to the longitudinal axis of the bore.

The inventors have determined that the configuration of the closure member with a high incident angle (i.e. 45° to 135°) relative to the longitudinal axis of the bore, confers a significant advantage to the connector blocks of the present invention. Specifically, the use of a low angle $\alpha$ (as shown in FIG. 2) can present limitations with regard to the extent the closure member can move away from the opening of the slot, and towards the housing. As can be seen in FIG. 2, the presence of the detonator within the housing restricts the potential movement of the closure member, and therefore the access to the slot. In comparison, the embodiment illustrated in FIG. 3, the closure member has more than ample space to move away from the opening of the slot without hindrance from the surface of the housing, thus permitting facile lateral insertion of a shock tube.

In accordance with the preferred embodiment shown in FIG. 3, the connector block includes a shock tube insertion guide 34 integral with the rigid shock tube retention means, and extending from the entrance of the slot. The shock tube insertion guide defines a receiving space 35 between the shock tube insertion guide and the closure member. In this way, the receiving space facilitates the lateral insertion of shock tubes into the connector block. This improves ease of operation and handling at the blast site. The shock tubes may be positioned in the receiving space and located adjacent to the entrance of the slot, in juxtaposition with the closure member. Upon application of pressure, the shock tube may be pushed past the closure member and into the slot, by deflection of the closure member away from its resting position. Preferably, the shock tube insertion guide is configured to provide a receiving space that is narrower at an end adjacent the entrance of the slot. In this way, the end of the receiving space opposite the entrance of the slot is wider for facile insertion of a shock tube therein.

Figure 4:
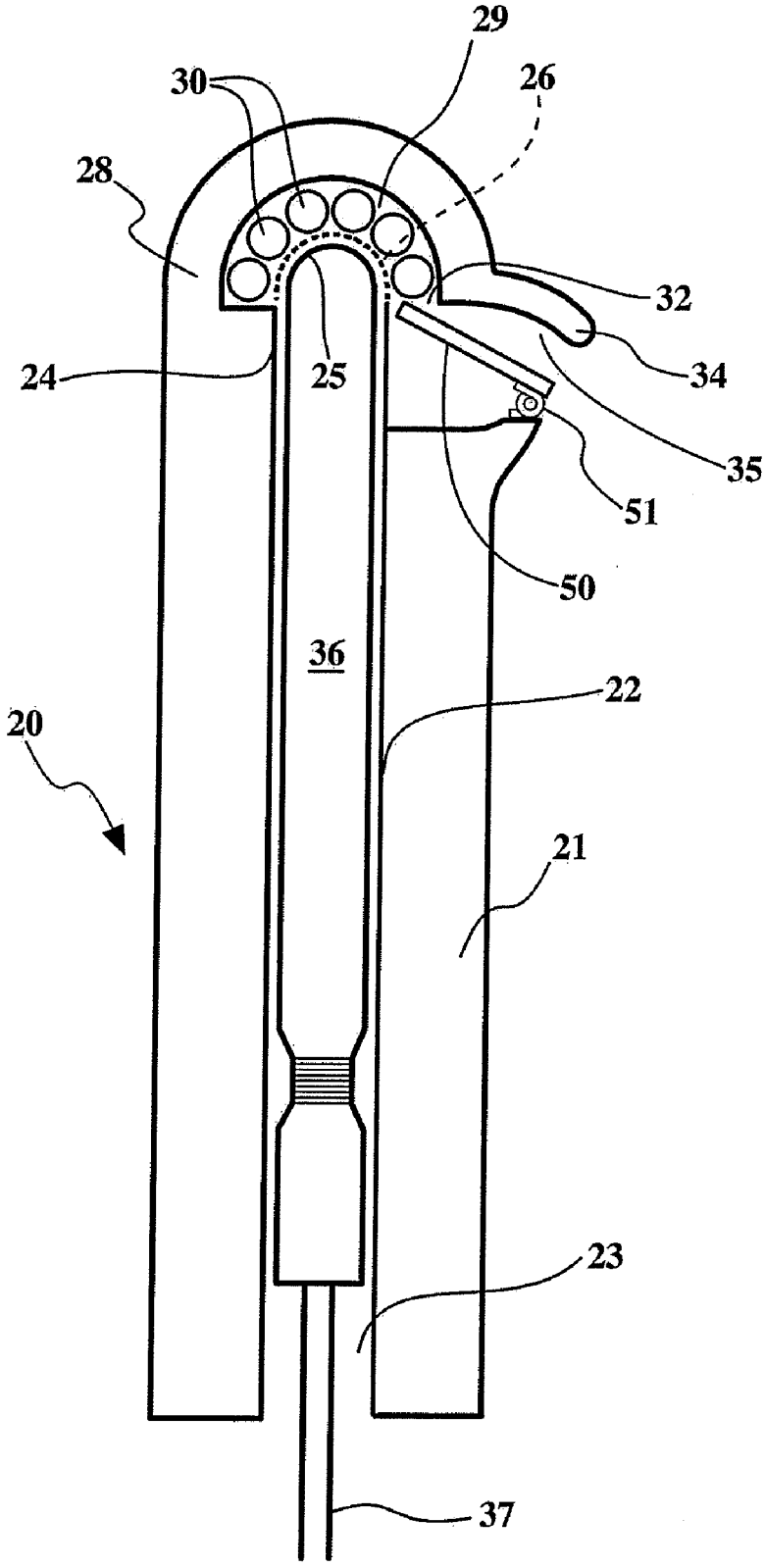
FIG. 4 is a cross-sectional view of a preferred embodiment of the present invention, wherein the closure member is attached to the housing by a sprung hinge.

A third embodiment of the present invention is illustrated in FIG. 4. This embodiment is similar to that shown in FIG. 3, with the exception that the connector block comprises an alternative closure member. Specifically, the closure member 31 is replaced by alternative closure member 50 and hinge 51. The closure member 31 (in FIG. 2) is integral to the housing of the connector block, and preferably comprises the same plastic material as the housing. In contrast, the alternative closure member 50 is not integral to the housing, but connected to the housing via the hinge 51. The hinge 51 is arranged to bias the position of the alternative closure member 50 to extend into, and partially or completely cover the entrance 32 to the slot 29. Upon application of a force to the alternative closure member, for example when a shock tube is pushed against it, the alternative closure member moves about the hinge against the bias of the spring, thereby revealing the entrance 32 of the slot 29. The shock tube may then be positioned in the slot 29, and the alternative closure member 50 will return to its resting position under the influence of the hinge 51. Preferably, the alternative closure member may contact a shock tube positioned within the slot 29 adjacent to the entrance 32, and assist in the retention of the shock tube.

In accordance with the embodiment illustrated in FIG. 4, the flexibility of the alternative shock tube retention means is conferred by the hinge 51. Therefore, the alternative closure member itself need not necessarily comprise a resiliently flexible material. In this regard, the alternative closure member may preferably comprise a metal, an alloy, a resin or composition with rigid properties.

Example 1

Comparison of the Handidet™ X405 Connector Block with a Connector Block of the Present Invention An experiment was carried out to compare the properties of a connector block of the present application, with those of a connector block from the Handidet™ X405 (Orica) series of connector blocks. A 3 mm diameter metal rod was inserted laterally into the slot of each connector block (the diameter of the metal rod was comparable to the diameter of a typical shock tube used in conjunction with the connector blocks).

Several comparative measurements were made for each connector block:

1) the maximal movement of the shock tube retention means
2) the maximal movement of the closure member (semi-rigid member)
3) the shock tube insertion force.

The results are shown in Table 1 below:

TABLE 1

| Connector block | 1) Max. movement of shock tube retention means/mm (relative movement*/%) | 2) Max. movement of closure member/mm (relative movement*/%) | 3) Insertion force/Newtons |
|---|---|---|---|
| Handidet ™ X405 | 2.3** (78%) | 0.3 (10%) | 36.9 |
| Present Invention | 1.1 (36%) | 1.9 (64%) | 28.9 |

*provides an indication of the relative overall movement of the shock tube retention means and the closure member to accommodate the shock tube upon insertion.
**the remaining 0.4 mm movement is taken up by the flexing of the flexible lip 111 of FIGS. 1a and 1b.

Therefore, as shown in Table 1, the insertion of a metal rod (of similar dimensions to a suitable shock tube) into a Handidet™ X405 connector block resulted in flexing of the semi-rigid (closure) member through a distance less than one sixth (15%) that of the shock tube retention means. In direct comparison, insertion of the same metal rod into a connector block of the present invention resulted in a movement of the (flexible and resilient) closure member through a distance 2 times greater than the movement of the shock tube retention means (of limited flexibility). The relative movements of the components of the connector blocks translated into significant improvements in the force required to insert a shock tube into the connector block of the present invention. In this regard, the force required to insert the rod into the Handidet™ X405 was 30% more than the force needed to insert the rod into the connector block of the present invention.

A further advantage of the connector blocks of the present invention relates to integrity upon detonator actuation. Connector blocks of the prior art, including the Handidet™ X405, are frequently prone to fragmentation upon detonator actuation, wherein the shock tube retention means can be blown off the connector block. The flexibility and reduced thickness of the shock tube retention means of the prior art are considered to contribute to the degree of fragmentation upon detonator actuation. For example, the thickness of the flexible shock tube retention means of the Handide™ X405 is less than half that of the shock tube retention means of the present invention. In this way, the shock tube retention means is frequently blown off the Handidet™ X405 when the detonator is actuated. In contrast, without wishing to be bound by theory it is believed that the relative inflexibility and increased thickness of the shock tube retention means of the connector blocks of the present invention, render the connector blocks more resistant to fragmentation when the detonator is actuated. Furthermore, the present design allows the insertion force, and the relative movements of the retention means and the closure member to suit any field requirements, without the design limitations imposed by the inclusion of a flexible shock tube retention means.

While the invention has been described with reference to particular preferred embodiments thereof, it will be apparent to those skilled in the art upon a reading and understanding of the foregoing that numerous connector block designs, and connector block/detonator assemblies, other than the specific embodiments illustrated are attainable, which nonetheless lie within the spirit and scope of the present invention. It is intended to include all such designs, assemblies, assembly methods, and equivalents thereof within the scope of the appended claims.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that that prior art forms part of the common general knowledge.

The invention claimed is:

1. A connector block for retaining at least one shock tube in signal transfer relationship with a detonator, wherein the connector block comprises:

a housing have a bore formed therein for receiving a detonator provided with a percussion-actuation end and a base charge disposed within the percussion-actuation end, the bore having an insertion end for receiving the detonator and a signal transmission end for positioning the percussion-actuation end of the detonator in signal transfer relationship with at least one shock tube when at least one shock tube is inserted in the connector block;

a substantially rigid shock tube retention means integral with the housing and extending to project over the signal transmission end of said bore, to define with said housing a slot for receiving therein at least one shock tube, whereby at least one shock tube is held in signal transfer relationship with a percussion-actuation end of a detonator present in said bore, when at least one shock tube is inserted in said slot and a detonator is inserted in said bore, said slot having an entrance for allowing insertion of at least one shock tube into said slot; and a closure member that is not integral to the housing, but that is connected to the housing hinge that is also not integral to housing, but that is sprung to thereby bias the closure member to partially or completely cover an entrance to the slot, the closure member allowing insertion of a shock tube into the slot upon application of an insertional force to said closure member so that the closure member is forced to move about the hinge against the bias of a spring to thereby uncover the entrance to the slot and permit access to the slot, the closure member being returned to its biased position under the influence of the spring after the insertional force is no longer applied to the closure member.

2. A connector block according to claim 1, wherein said connector block is configured to permit entry of at least one shock tube by applying an insertional force of less than about 45 Newtons.

3. A connector block according to claim 1, wherein said sprung hinge and said closure member, in its biased position, prevent inadvertent removal of at least one shock tube from said slot when at least one shock tube is inserted in said slot.

4. A connector block according to claim 1 whereby said closure member assists in the retention of a shock tube adjacent to the entrance of the slot by contacting a shock tube when a shock tube is inserted in the slot.

5. A connector block according to claim 1, wherein the connector block substantially comprises a plastic material.

6. A connector block according to claim 1, wherein the closure member comprises a metal.

7. A connector block according to claim 6, wherein the metal is a metal insert, and the metal insert is partially for completely enveloped in a plastic material.

8. A connector block according to claim 1, wherein the closure member extends partially or fully into said entrance at an angle of from 45° to 135° relative to the axis of the bore.

9. A connector block according to claim 8, wherein the closure member extends partially or fully into said entrance at an angle of from 45° to 90° relative to the axis of the bore.

10. A connector block according to claim 1, wherein the connector block further comprises:

a positioning membrane located within the bore for positioning the percussion-actuation end of the detonator in signal transfer relationship with at least one shock tubes in said slot.

11. A connector block according to claim 1, wherein the connector block further comprises:

a shock tube insertion guide integral with the shock tube retention means of limited flexibility, the shock tube insertion guide defining with said closure member a receiving space to guide at least one shock tube to said entrance of said slot.

12. A connector block according to claim 11, wherein the receiving space narrows at an end adjacent said entrance of said slot.

13. A connector block according to claim 1, whereby, when at least two shock tubes and a detonator with a hemispherical surface at a percussion-actuation end of the detonator are inserted in the slot, the at least two shock tubes are arranged around the hemispherical percussion-actuation end of the detonator substantially equidistant from a base charge within the detonator.

14. A connector block according to claim 1, wherein the slot can accommodate up to six shock tubes.

15. The connector block according to claim 1, wherein the closure member is comprised of a material selected from the group consisting of metal, an alloy, a resin and a composition with rigid properties.

16. The connector block according to claim 1, wherein the closure member is comprised of a rigid material that is at least partially different from a material from which the housing is made.

* * * * *